United States Patent [19]

Chew

[11] Patent Number: 4,700,278

[45] Date of Patent: Oct. 13, 1987

[54] MOLDED PLASTIC BRACKET FOR LAMP RECEPTACLE

[75] Inventor: James P. Chew, Jeannette, Pa.

[73] Assignee: American Standard Inc., North Hills, Pa.

[21] Appl. No.: 810,623

[22] Filed: Dec. 19, 1985

[51] Int. Cl.[4] ..... F21V 21/00

[52] U.S. Cl. ..... 362/249; 340/50; 362/382

[58] Field of Search ..... 362/382, 61, 249, 433, 362/368, 362, 448, 455, 20; 340/47.50; 339/263 R, 125 R, 164 R, 164 M, 164 L, 165

[56] References Cited

U.S. PATENT DOCUMENTS

| | | | |
|---|---|---|---|
| 1,453,535 | 5/1923 | Wells | 340/50 |
| 1,978,334 | 10/1934 | Adler | 340/50 |
| 3,018,464 | 1/1962 | Mrenna et al. | 339/263 R |
| 4,042,820 | 8/1977 | Baader et al. | 362/382 |
| 4,520,435 | 5/1985 | Baldwin | 362/361 |

FOREIGN PATENT DOCUMENTS

| | | | |
|---|---|---|---|
| 322262 | 12/1929 | United Kingdom | 340/50 |

*Primary Examiner*—Charles J. Myhre
*Assistant Examiner*—D. M. Cox
*Attorney, Agent, or Firm*—J. B. Sotak

[57] ABSTRACT

A railway light signal having a pair of lenses carried by a frame member and having a lamp receptacle including a one-piece molded plastic bracket having a flat top surface upon which is mounted a pair of lamp sockets and light bulbs, having a pair of laterally extending flanges which are screw-mounted to the frame, and having an apertured depending rear wall for accommodating a pair of terminal posts which supply power to the pair of lamp sockets for illuminating the light bulbs.

5 Claims, 7 Drawing Figures

MOLDED PLASTIC BRACKET FOR LAMP RECEPTACLE

FIELD OF THE INVENTION

This invention relates to a molded plastic bracket for accommodating a pair of lamps and sockets of a light signal unit and, more particularly, to a flame-retardant, fiberglass-reinforced thermosetting polyester bracket for accurately positioning and supporting dual electric signal lamps in a railway signalling unit.

BACKGROUND OF THE INVENTION

It is common practice to employ a pair of electric bulbs or lamps in combination with an optical lens system in a railway and mass and/or rapid transit operation for signalling purposes. Currently, the dual-lamp receptacles are constructed by attaching two single contact bayonet candelabra sockets to an insulating board with machine screws and nuts. The sockets are mounted on soldered brackets and machined spacers hold the lamps in the desired position. A pair of standard binding posts are also mounted on the insulated board and a separate anti-turn device is applied to each post in order to prevent the threaded posts from turning. The complete lamp receptacle is mounted to the lens structure by a pair of cap screws and two machined spacers. This previous method of construction requires a myriad of small parts and machined pieces to form the receptacle that holds the sockets in place. It will be appreciated that the machining tolerances and allowances involved during the manufacture of the spacers will materially affect the distances from the lamps to the lens system which causes an inconsistency of the light intensity that exists between individual signal units. Thus, these previous signal units were expensive to machine as well as to assembly and were difficult to adjust to provide consistent light intensities.

OBJECTS AND SUMMARY OF THE INVENTION

Accordingly, it is an object of this invention to provide a new and improved lamp bracket for light signal units.

Another object of this invention is to provide a novel molded plastic bracket which carries a pair of lamp sockets and which is mounted to the frame of a light signal unit.

A further object of this invention is to provide a unique one-piece reinforced plastic lamp receptacle bracket for supporting a dual-lamp arrangement for a signal unit.

Yet another object of this invention is to provide a unitary molded plastic bracket which carries a pair of lamps which may be quickly mounted and accurately positioned in relation to the lens system of a light signal.

Yet a further object of this invention is to provide a standard interchangeable bracket member for supporting a pair of lamps which are utilized to illuminate a railway light signal.

Still another object of this invention is to provide a low-cost dual-lamp receptacle for rapid transit light signals.

Still a further object of this invention is to provide a molded plastic bracket for a dual-lamp receptacle of a light signal comprising, a body portion having a flat horizontal lamp supporting portion including a pair of openings for accommodating a pair of lamp holders, a frontal flange portion being connectable to an inner peripheral edge of a frame member of the light signal and a rearward portion for accepting a pair of conductive binding posts which supply power to the pair of lamp holders for causing the illumination of a pair of lamps.

Still a further object of this invention is to provide a molded plastic bracket for a dual-lamp receptacle of a light signal with an integral method of mounting conductive binding posts such that, the binding posts cannot be accidently rotated when they are connected to an external source of power.

Still another object of this invention is to provide a complete dual-lamp receptacle for a light signal that utilizes the molded bracket in which the complete receptacle is readily interchangeable with the receptacle in current use in the field.

Furthermore, it is an object of this invention to provide a complete dual-lamp receptacle utilizing the molded bracket for a light signal, constructed in such a manner that all the lenses of the light signal unit may be readily removed without removing or disturbing the dual-lamp receptacle.

An additional object of this invention is to provide a light signal unit comprising, an optical lens system supported by a frame member and a dual-lamp light source carried by a lamp receptacle which is attached to the frame member, the lamp receptacle includes a one-piece molded plastic bracket upon which is mounted a pair of lamp sockets which are electrically connected to a pair of supply terminal posts to cause the illumination of a pair of light bulbs.

BRIEF DESCRIPTION OF THE DRAWINGS

The above objects and other attendant features and advantages of the present invention will become more readily understood when considered in conjunction with the accompanying drawings, wherein.

DETAILED DESCRIPTION OF THE INVENTION

Figure 1:
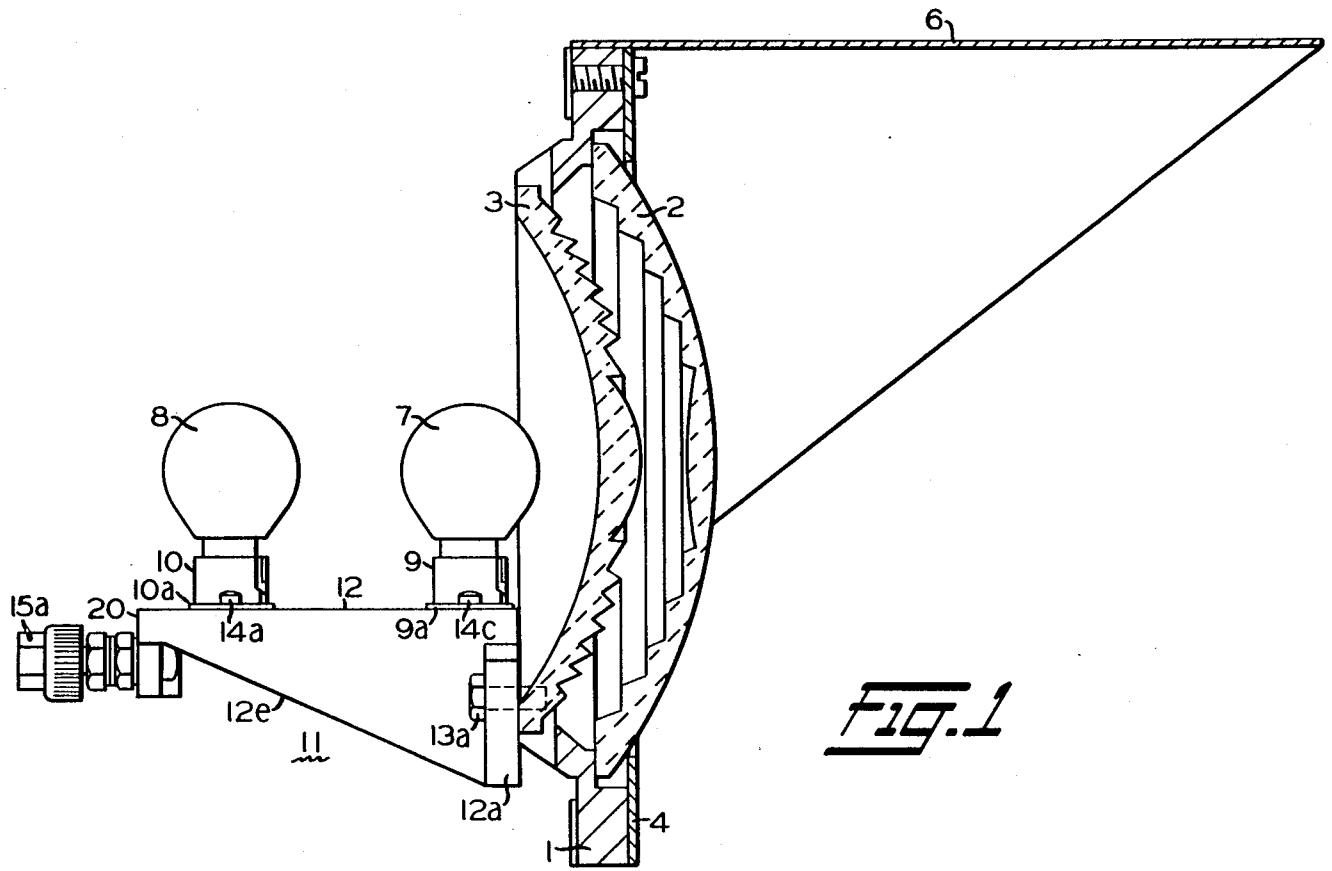
FIG. 1 is a side view illustrating partly in vertical section and partly in side elevation, one form of a molded plastic lamp bracket for use in a light signal in accordance with the present invention.
Figure 2:
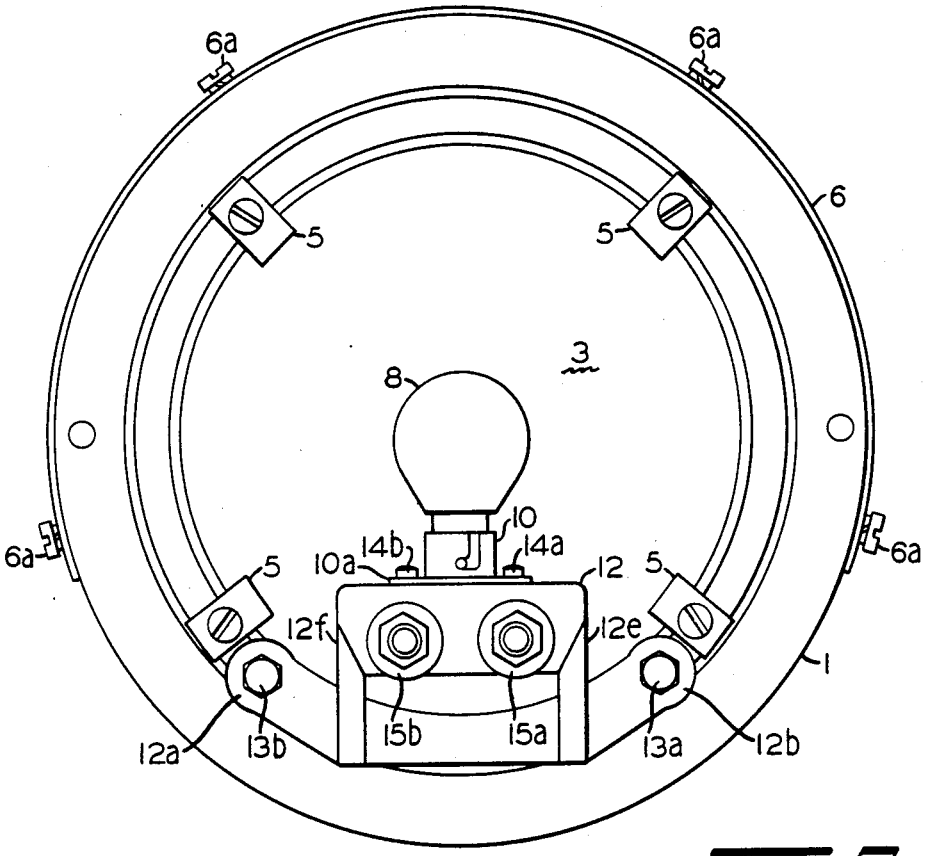
FIG. 2 is a rear elevational view of the light signal of FIG. 1.

Referring now to the drawings, and in particular to FIGS. 1 and 2, there is shown a light signal unit in which the metal protective casing and the removable rear cover have been omitted for the sake of clarity and convenience. The light signal comprises, a ring-like frame or support member 1 which holds the optical lens system for projecting a beam of substantially parallel rays of radiant energy emanating from a source of light. As shown, the optical system includes a doublet lens combination comprising a front lens 2 and a back lens 3 which are fixed to a frame or casting 1 by a retaining ring 4 and retaining clips 5, respectively. A sun-shade or hood 6 is suitably fastened to the front outer peripheral edge of frame 1 by suitable screws 6*a*.

It will be appreciated that the normal source of light is provided by a pair of incandescent lamps or light bulbs 7 and 8 in which the filament of the primary bulb 7 is located at the focal point of the doublet lens combination. As shown, the auxiliary incadescent lamp or light bulb 8 is mounted in the back of the main or primary lamp 7. The function of the auxiliary lamp 8 is to maintain at least some illumination of the light signal in the event that the main lamp burns out or is extinguished for any other reason. While the filament of the auxiliary lamp 8 is a considerable distance from the focal point of the doublet lens combination, its primary function is to keep the light signal illuminated until a defective main lamp is removed and replaced.

Figure 3:
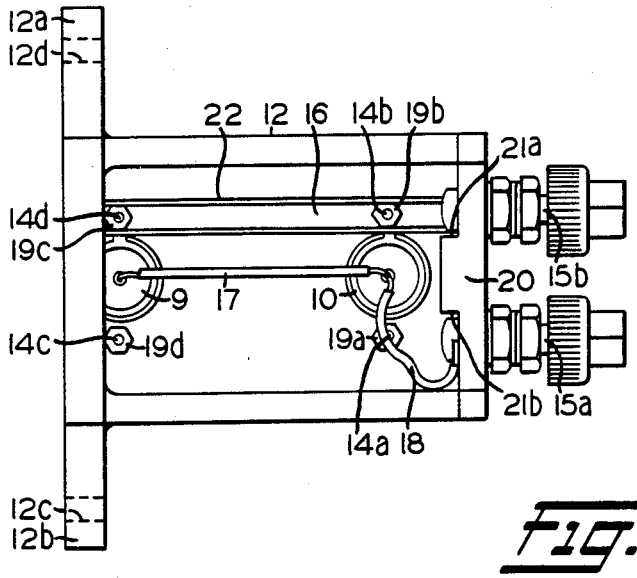
FIG. 3 is a bottom plan view of the underside of the lamp receptacle which is shown without the optical lens system.

The lamps 7 and 8, which may be single-contact bayonet candelabra light bulbs, have their bases inserted into the respective sockets or holders 9 and 10 which are carried by the lamp receptacle generally characterized by number 11. The lamp receptacle includes a one-piece or unitary molded plastic bracket member 12 which is securely fastened to the inner side of the frame or casting 1 by a pair of machine screws 13*a* and 13*b*. As shown, the two lamp sockets 9 and 10 are mounted on the top surface of bracket 12 and are secured thereto by screws 14*a*–14*b* and 14*c*–14*d* which pass through appropriate holes formed in mounting flanges 9*a* and 10*a*. A pair of suitable leads or conductors (not shown) are connected to a pair of standard AAR conductive binding posts 15*a* and 15*b* for supplying the electrical power for illuminating the lamps 7 and 8. Each of the conventional binding posts includes a square-headed screw, a securing nut, a clamping nut, and a binding nut, as well as a number of washers and an insulative terminal cover or cap (all of which are not characterized). In viewing FIG. 3, it will be seen that electrical current is conveyed to the sockets 9 and 10 and, in turn, to lamps 7 and 8 via a conductive strip 16 and insulated leads 17 and 18. As shown, an electrical circuit path extends from binding post 15*a*, through insulative lead 18 to the center terminal of socket 10, through the filament of lamp 8, to the conductive shell of socket 10, through screw 14*b*, through nut 19*b*, and through the lower end of conductive strip 16 to binding post 15*b*. A parallel circuit path extends from the center terminal of socket 10, through insulative lead 17 to the center terminal of socket 9, through the filament of lamp 7, to the conductive shell of socket 9, through screw 14*c*, through nut 19*c*, and through the upper end of conductive strip 16 to the lower end of conductive strip 16.

Turning now to FIGS. 4, 5, 6 and 7, there is shown the unique unitary plastic bracket 12 which is shown devoid of all of the electrical elements and detached from the lens system of the light signal unit. The one-piece bracket 12 is constructed of black flame-retardant, fiberglass-reinforced therosetting polyester material which may be compression or injection molded into a rigid plastic member. Thus, the unitary molded plastic bracket 12 obviates the need of any expensive machining, assembly of bracket, or finishing operations. Further, since each bracket is a solid molded plastic part, all of the proportions or measurements of the manufactured brackets will be dimensionally consistent. This dimensional consistency will ensure accurate positioning of the two lamps relative to the lenses when the receptacle is assembled to the light signal unit. Thus, the light intensity of each assembled light unit is relatively the same and, therefore, the need of repetitious testing and adjusting is minimized. Accordingly, the minimized variation in light intensity between assembled light units is both time and cost effective. In addition, the myriad of minute components has been eliminated, and only the need of the electrical connections, the lamp sockets, and the binding posts are required to be assembled to the bracket to form a ready-to-be-installed receptacle.

Figure 4:
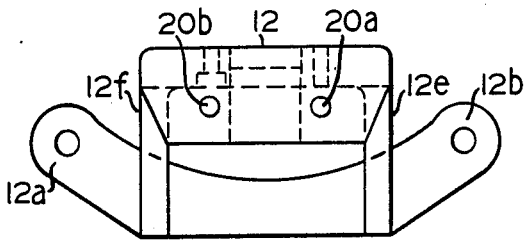
FIG. 4 is a rear elevational view of a lamp mounting bracket included in the light signal of FIG. 1.
Figure 5:
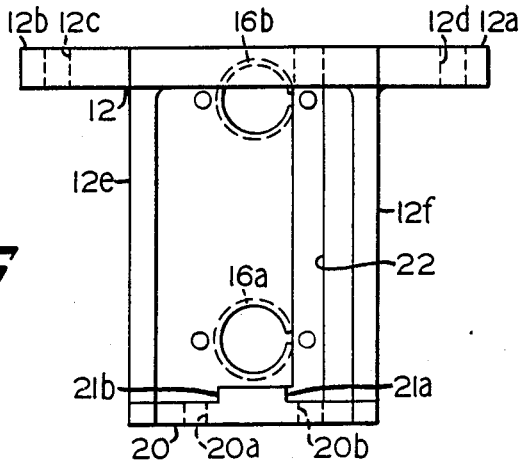
FIG. 5 is a bottom plan view of the bracket.
Figure 6:
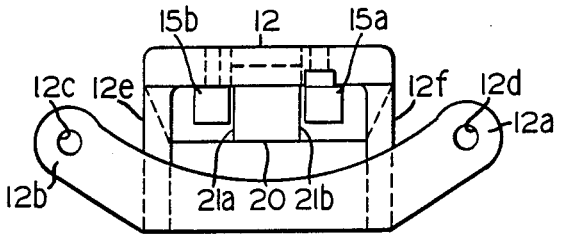
FIG. 6 is a front elevational view of the bracket in which the square heads of the binding posts are shown in contiguous relation to the flat-sided walls of the rearward depending wall section.
Figure 7:
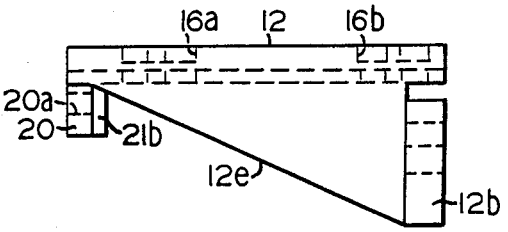
FIG. 7 is a side elevational view of the bracket.

Referring now to FIGS. 4 and 6, it will be seen that the uniquely molded plastic bracket includes a pair of laterally extending flanges 12*a* and 12*b* which include two holes 12*c* and 12*d* for mounting the receptacle to the lens unit casting. The two circular holes 16*b* and 16*a*, located in the frontal and rearward portions of the horizontal section of the bracket 12, are used to retain and position the bodies of the lamp sockets or bases 9 and 10. The holes 16*b* and 16*a* are counterbored to accept the lip of the mounting flange of the lamp sockets 9 and 10. The flange portions of the sockets 9 and 10 are secured by the screws 14*a* through 14*d* and nuts 19*a* through 19*d* to the body of the plastic bracket 12. In addition, the horizontal body portion of the plastic bracket member 12 includes a preformed elongated channel or groove 22, formed on the underside thereto, for accommodating the conductive strip member 16 which provides the common connection for the electrical lamps 7 and 8. The bracket member 12 is also provided with a pair of holes 20*a* and 20*b*, formed in the rearward depending wall section 20, to accommodate the two AAR screw binding posts 15*a* and 15*b*. A pair of tapered side reinforcing ribs 12*e* and 12*f* extend from the front to the rear of the bracket body 12 to increase the strength or rigidity of the structure. A pair of flat-sided walls 21*a* and 21*b* are formed between holes 20*a* and 20*b*, and are adapted to engage the contiguous sides of the square heads of the binding post screws to prevent the screws from turning, which thereby eliminates the need of ancillary and separate anti-turn pieces. Thus, it will be seen that the one-piece molded bracket provides a unique and uniform assembly member for the lamp receptacles of railway and mass and/or rapid transit light signal units.

It will be appreciated that various changes and modifications may be made by those skilled in the art without departing from the spirit and scope of the claimed invention. Therefore, it is understood that all alterations, ramifications, and equivalents may be readily apprehended by those persons skilled in the art, and thus it will be appreciated that the present invention is not to be limited to the exact embodiment described herein but is to be accorded the full scope and protection of the appended claims.

I claim:

1. A molded plastic bracket for a dual-lamp receptacle of a light signal comprising, a body portion having a horizontal lamp-supporting portion including a pair of openings for accommodating a pair of lamp holders, a front flange portion being connectable to an inner peripheral edge of a frame member of the light signal, a rear flange portion for accepting a pair of conductive square-headed binding posts which supply power to the pair of lamp holders for causing the illumination of a pair of lamps, said rearward portion includes a pair of holes for receiving said pair of conductive square-headed binding posts, and a pair of flat side walls are formed between said pair of holes to prevent the square-headed binding posts from turning.

2. The molded plastic bracket, as defined in claim 1, wherein said frontal flange portion includes a pair of holes for accommodating a pair of screws for securing the bracket to said frame member, said frontal flange portion being constructed in such a manner that a lens system may be removed for maintenance, without disturbing or removing said molded plastic bracket.

3. The molded plastic bracket, as defined in claim 1, wherein a reinforcing rib is located on each side of said horizontal lamp-supporting portion which extends from said front flange portion to said rear flange portion.

4. The molded plastic bracket, as defined in claim 1, wherein the bracket is constructed of a flame-retardant, fiberglass-reinforced thermosetting polyester material.

5. A molded plastic bracket for a dual-lamp receptacle of a light signal comprising, a body portion having a horizontal lamp-supporting portion including a pair of openings for accommodating a pair of lamp holders, a front flange portion being connectable to an inner peripheral edge of a frame member of the light signal, and a rear flange portion for accepting a pair of conductive binding posts which supply power to the pair of lamp holders for causing the illumination of a pair of lamps, and an elongated channel is formed on the underside of said horizontal lamp-supporting portion for accommodating a conductive strip which is connected to said pair of lamp holders.

* * * * *